United States Patent [19]

Pitt

[11] Patent Number: 4,640,624

[45] Date of Patent: Feb. 3, 1987

[54] TIME COMPUTER AND DISPLAY DEVICE

[76] Inventor: Peter N. E. Pitt, 60 Wierda Road East, Wierda Valley, Sandton 2196, South Africa

[21] Appl. No.: 609,328

[22] Filed: May 11, 1984

[30] Foreign Application Priority Data

May 16, 1983 [ZA] South Africa ..... 83/3467

[51] Int. Cl.[4] ..... G04F 8/00; G04F 10/00

[52] U.S. Cl. ..... 368/111; 368/113

[58] Field of Search ..... 368/10, 82, 107–113; 377/5, 20; 364/569

[56] References Cited

U.S. PATENT DOCUMENTS 4,285,041 8/1981 Smith ..... 377/5 X 4,337,529 6/1982 Morikawa ..... 368/109

*Primary Examiner*—Vit W. Miska

*Attorney, Agent, or Firm*—D. Peter Hochberg

[57] ABSTRACT

An electronic time computer and display particularly suitable for use by road race runners in the form of an electronic stop watch indicating cumulative time and including a second display indicating an element of time between the latest two actuations of an operating switch and a third display of the average element of time between all previous consecutive actuations of the operating switch. The computer will also include a display of a predetermined element of time for covering a unit distance selected through an independent control and a display for that element of time to be taken before the next actuation of the operating switch to achieve an average element of time for all the unit distances covered equal to the predetermined element of time for the unit distance.

6 Claims, 3 Drawing Figures

TIME COMPUTER AND DISPLAY DEVICE

BACKGROUND TO THE INVENTION

This invention relates to a device for measuring and computing elements of time on a current and cumulative basis, with the results being displayed in a digital form.

In long distance races it is desirable for a competitor to know his rate of travel over predetermined and consecutive distances of the total distance travelled, known as "splits" so that he may vary his pace as required to achieve his objective average speed for the entire course.

Thus, for example, in a standard 42 kilometer marathon, a runner may decide to run at an average speed of 14 kilometers per hour to complete the race in a predetermined time of 3 hours. To do this effectively, the runner should be aware of the time taken for consecutive stretches of say 3 kilometers each of the total distance, the average time of all preceding stretches and the extent to which time for further stretches must be varied to achieve completion of the race within 3 hours. Obtaining such information by mental calculation during a race is virtually impossible.

SUMMARY OF THE INVENTION

It is the object of the present invention to provide a means for easily providing the information referred to above.

According to this invention there is provided a time computer and display device comprising an electronic stopwatch indicating cumulative time, a second display indicating an element of time between the latest two actuations of an operating switch and a third display of the average element of time between all previous consecutive actuations of the operating switch.

Further features of the invention provide for the latter two displays of elements of time to be given in measurements of time for unit distance, for a display of a predetermined number indicating the number of units selected for determining the actuation of the operating switch for a particular application of the computer and for the device to be suitable for wearing by a user in a manner similar to a wrist watch.

Still further features of this invention provide for the additional display of a predetermined time for covering a unit distance selected through an independent control and a display for that element of time to be taken before the next actuation of the operating switch to achieve an average element of time for the unit distance.

DETAILED DESCRIPTION

A preferred embodiment of this invention will be described with reference to the accompanying drawings in which.

Figure 3:
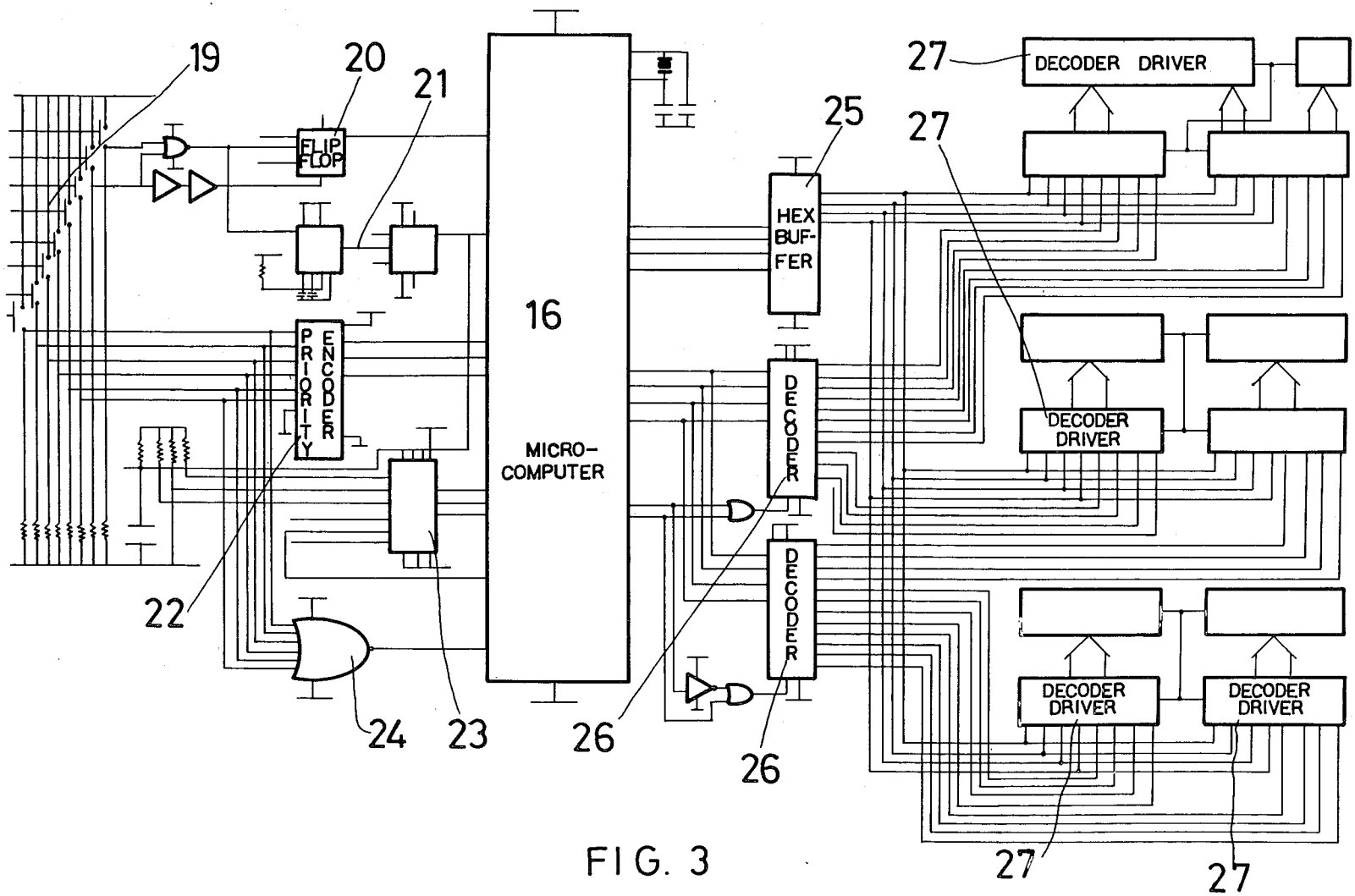

FIG. 3 a circuit diagram of one example of the invention.

Figure 1:
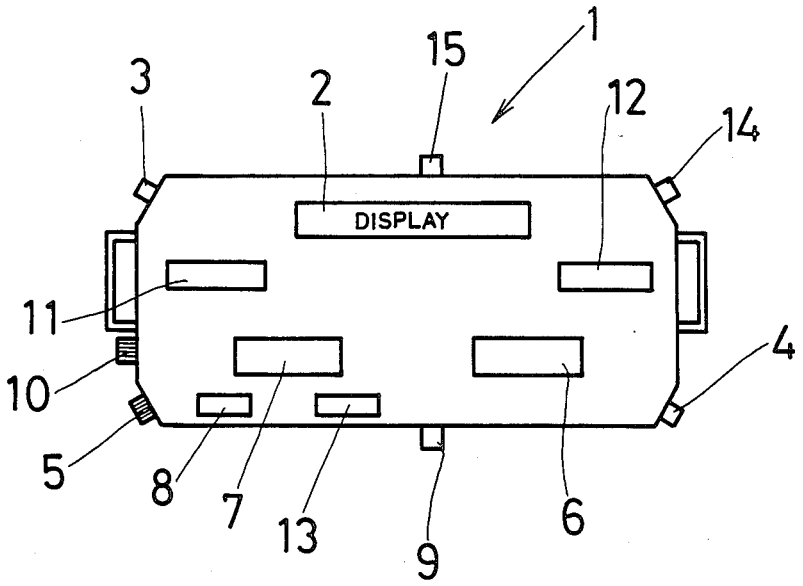
FIG. 1 shows an arrangement of the invention suitable for use by a road race runner.

Referring to FIG. 1 the device 1 will be made of a size suitable to be secured to the wrist of the user by means of a suitable strap.

The device 1 consists essentially of a stopwatch mechanism with a display 2 therefor, and start-stop operating button 3. The time recorded by this mechanism will preferably be "frozen" in display 2 for a 5 second period upon actuation of the operating switch 4, simultaneous with which operation of an electronic calculating device will display separate pieces of information in windows 6, 7 and 12. The display may remain fixed until the next actuation of the switch 4.

A pre-selected unit of distance control is included in the mechanism, selectable over a range of 1 to 21 units in increments of 1 on actuation selector button 5. This pre-selector is set by the user to reflect in window 8 the unit distances over which elements of time will be computed and will directly determine the number of times that the operating switch 4 is to be operated during a particular use of the device. This enables the displays to indicate the time per unit distance between the latest two consecutive actuations of the operating switch 4 in window 6 and the average time per unit distance for all consecutive pairs of actuations of the operating switch 4 in window 7. Thus, for a particular race the pre-selector will be set and display the distance of the splits chosen, the cumulative time taken at any stage in the race, the unit speed achieved during the latest split and the average unit speed achieved for all complete splits.

A mode control button 9 will enable either the display above to be viewed or alternatively a display with a target time for each split and the unit speed for the next split to bring the average for all completed splits to the target time.

This latter display is obtained through a further pre-selector control 10 which enables the target time per unit distance to be diplayed into window 11. Upon actuation of the operating switch 4 above, the device will display in window 12 that time per unit distance at which the next unit distance must be run, to achieve an average time per unit distance reading in window 7 equivalent to the preselected target time displayed in window 11.

As a safety feature relating to proper actuation of the operating switch 4, a further window 13 might be provided indicating the number of times the operating switch 4 has been actuated since operating the start mechanism.

If the particular race is a standard 42 kilometer marathon, the runner will want to know his total time elapsed at any point during the race, the time taken per kilometer over consecutive splits of say 3 kilometers each and the average time per kilometer for the whole distance covered at any time. Additionally, an indication should be available as to the extent the runner should increase or decrease his pace in order to run at the predetermined speed which he has set himself for the race. In this instance the predetermined speed might be say 4 minutes per kilometer.

To set up the time computer the runner will operate the pre-selector 5 to obtain the number "3" in window 8 and pre-selector 10 to show the number "4" in window 11, thereafter pressing the start button 3 when the race commences. As he passes the first 3 kilometer mark, he will actuate the operating switch 4 and this will result in an identical display in windows 6 and 7, which will be his time per kilometer for the first three kilometers. Simultaneously, window 12 will register the time per kilometer at which the next 3 kilometers will need to be run, to give an average reading in window 7 equivalent to that of window 11, upon next actuation of the operations switch 4 at the 6 kilometer mark.

After the next three kilometers have been run, operating switch 4 will again be actuated and the time per kilometer for these three kilometers will be displayed in window 6, while the time per kilometer for all six kilometers will be displayed in window 7. Window 12 will again display time per kilometer required during the next 3 kilometer stretch, to give similar reading in windows 7 and 11 after the 9 kilometer actuation. The number "2" will be displayed in window 13 and the total time elapsed in window 2 "frozen" for a 5-second interval.

This procedure will be repeated with the actuation of operating switch as each consecutive 3 kilometer distance is travelled and the runner will thus at all times know his current speed and average speed and know by what amount to increase or decrease speed to achieve and maintain a predetermined average speed for the race by operating mode control button 9 to obtain the appropriate display.

At the end of the 42 kilometer course, the stop button will be pressed to cease operation of the device giving the overall time for the race and the runner's average speed.

It will be appreciated that the mode control will enable windows 13 and 8 to be made as a single unit.

Other controls will include the reset push button 14 operation of which will return all the displays to zero ready to be set up for the next race.

A further control button 15 can be provided which will enable a recall display to be produced which will be a sequestial display of current split times taken during the race in reverse order and for periods of 5 seconds each of on each operation of this button.

An on-off overall control can also be included if desired.

While eight independent controls are described above it will be appreciated that only two, the mode control 9 and operating switch 4, need be used by the runner during a race. Also by increasing the number of modes the number of control switches can also be reduced. The controls to be used during a race can be remote controlled in any suitable manner if desired.

Figure 2:
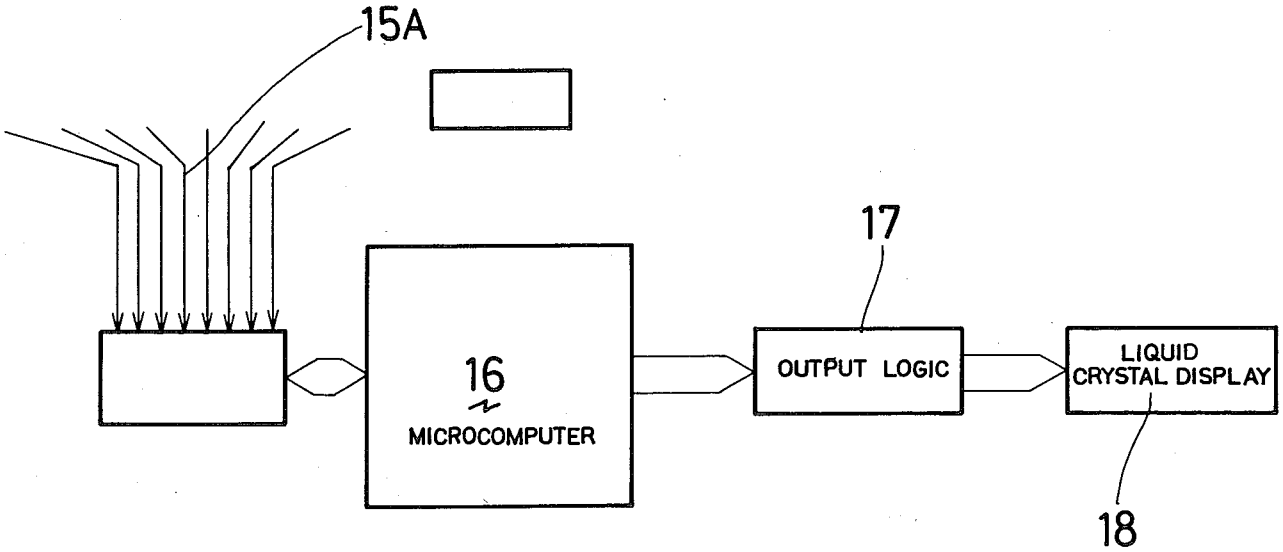
FIG. 2 is a logic diagram of the electronics.

The FIGS. 2 and 3 indicate the electronics which can be used in one form of the time computer and display described above.

The logic diagram of FIG. 2 indicates the inputs into unit 15A which is the digital logic to decode the inputs applied to the microcomputer system 16. This provides an output digital logic 17 to drive the liquid crystal displays 18.

The circuit diagram of FIG. 3 indicates that the device can be built up from commercially available integrated circuits. As shown the inputs at 19 are fed to the microcomputer 16 through one or other of the flip-flop 20, timer and flip-flop 21, priority encoder 22, multiplexer 23 and input NOR 24. The microcomputer outputs are fed through the hex buffer 25 and decoders 26 to the digit liquid crystal display decoder drivers 27.

On a reset (including after switching on) the internal timer is programmed to provide a pulse every millisecond, which interrupts the microprocessor and updates the timing registers. Registers are kept for milliseconds, seconds, minutes and 1/100 minutes the displays are updated every 10 milliseconds. It will be understood that the displays can be designed to be in minutes and seconds and parts thereof only and not include decimal fractions of minutes.

All inputs, except the on/off and reset inputs, are vectored and can thus be individually identified. The split target time and split distance are entered by a simple incrementer, and are inactive once the start signal has been pressed. Timing and calculations are not begun until the start signal has been activated.

Every time the operating switch 4, which signals a completed split distance, is pressed all calculations are renewed and appropriate displays updated.

Arithmetic calculations are easily achieved as the microprocessor has a multiplication instruction and a division routine which shifts and subtracts, is programmed.

The time per unit distance at which the next split is to be run to achieve an average split time equal to the target split time is calculated according to the following routine.

Required Time=Target Time
(1+activation)−(Current Time/Split Distance).

What I claim as new and desire to secure by Letters Patent is:

1. A time computer and display device comprising an electronic stopwatch having an operating switch and including first time means for measuring and indicating cumulative time, second time means for measuring and indicating an element of time between the latest two actuations of the operating switch and a third time means for measuring and indicating the average element of time between all previous consecutive actuations of the operating switch.

2. A device as claimed in claim 1 in which the second and third time means indicate and measure time per unit distance.

3. A device as claimed in claim 1 and further including fourth time means for enabling the selection and indication of a predetermined number indicating the units selected for determining the actuation of the operating switch for a particular application of the device.

4. A device as claimed in claim 2 and further including fifth time means for enabling the selection and indication of a predetermined time for covering a unit distance selected through an independent control, and sixth time means for measuring and indicating that element of time to be taken before the next actuation of the operating switch to achieve an average element of time for all the unit distances covered equal to said predetermined element of time for the unit distance.

5. A device as claimed in claim 1 wherein said device is a road race runner timing device.

6. A device according to claim 1 wherein said device comprises a wrist watch.

* * * * *